US005521574A

United States Patent [19]

Lebschy et al.

[11] Patent Number: 5,521,574

[45] Date of Patent: May 28, 1996

[54] COIL FOR AN ELECTROMAGNETIC RELAY

[75] Inventors: Reinhold Lebschy, Evora; Josef Kern, Berlin, both of Germany

[73] Assignee: Siemens Aktiengesellchaft, Munich, Germany

[21] Appl. No.: 232,124

[22] PCT Filed: Sep. 3, 1992

[86] PCT No.: PCT/DE92/00737

§ 371 Date: Apr. 28, 1994

§ 102(e) Date: Apr. 28, 1994

[87] PCT Pub. No.: WO93/09556

PCT Pub. Date: May 13, 1993

[30] Foreign Application Priority Data

Oct. 31, 1991 [DE] Germany ..... 41 36 005.2

[51] Int. Cl.[6] ..... H01F 15/10; H01F 27/30

[52] U.S. Cl. ..... 336/192; 335/299; 336/208

[58] Field of Search ..... 336/198, 208, 336/192; 335/299

[56] References Cited

U.S. PATENT DOCUMENTS

| | | | |
|---|---|---|---|
| 1,456,108 | 5/1923 | Johannesen | 336/208 |
| 3,328,736 | 6/1967 | Keck | 336/208 |
| 3,559,134 | 1/1971 | Daley | 336/198 |

FOREIGN PATENT DOCUMENTS

| | | | |
|---|---|---|---|
| 204442 | 7/1956 | Australia | 336/198 |
| 64115 | 11/1945 | Denmark | 336/208 |
| 304063 | 9/1968 | Sweden | 336/208 |

*Primary Examiner*—Thomas J. Kozma
*Attorney, Agent, or Firm*—Hill, Steadman & Simpson

[57] ABSTRACT

The coil has a coil former having an essentially cylindrical coil tube (2) as a support for a winding (5). Arranged on the external circumference of the coil tube are tab-shaped projections (8) which extend into the winding stack (5) and prevent twisting and axial movement in the event of the winding shrinking.

5 Claims, 2 Drawing Sheets

COIL FOR AN ELECTROMAGNETIC RELAY

BACKGROUND OF THE INVENTION

1. Field of the Invention

The invention relates to a coil for an electromagnetic relay having a coil former which forms a coil tube, whose basic shape is cylindrical, as a support for a winding stack as well as two flanges as axial boundaries of the winding space in each case.

2. Description of the Related Art

In the case of electromagnetic relays, a round magnetic soft-iron core is frequently used inside the excitation winding to guide the flux, for which reason the coil former, which is composed of insulating material and supports the winding, likewise has a coil tube of a cylindrical shape. The winding, which is composed of round copper wires which are thermoplastically sheathed, is fitted under tension into the winding space on this coil tube between both flanges so that the winding stack is initially seated firmly and such that it cannot move on the coil tube. The winding ends are connected, for example, to connecting wires in the coil flanges, strain relief normally being provided in order that the winding ends, which are subject to tension, do not tear in the event of temperature-dependent changes or changes produced by mechanical stress.

However, as a result of temperature and time influences, the winding shrinks because of the wire insulation shrinking, and this means that the external diameter and the length of the winding become smaller while the internal diameter becomes larger. In consequence, the winding stack becomes loose on the coil tube and can move in the axial and radial directions. As a result of additional forces acting from the outside, such as vibration, shock stress and temperature change, there is a risk of an interruption in the winding wire ends between the winding and the connecting ends which are anchored, for example, firmly in a coil former flange. Such vibration stresses occur particularly when a relay is installed in a moving apparatus, for example in a motor vehicle.

SUMMARY OF THE INVENTION

The object of the invention is to provides a coil of the type mentioned initially such that such external force influences cannot lead to the winding being displaced or twisted, and hence to the winding ends being endangered, even if the winding stack shrinks.

This object is achieved according to the invention in that at least one projection, which engages in the winding stack, is constructed on the external circumference of the coil tube. A plurality of projections, in the form of tabs or cones, are preferably arranged in a common radial plane, distributed over the circumference of the coil tube. The arrangement of the projections in a single radial plane prevents stresses from being caused inside the winding stack by the projections. It is furthermore expedient to arrange the projection or the projections in the vicinity of that coil flange to which the winding starts and ends are attached. This ensures that a shrinking winding is pulled in the direction of the endangered winding start and that it is thus prevented from being stressed in the longitudinal direction.

Instead of projections from a continuously circular envelope surface, it can also be provided that the external circumference of the coil tube has at least one flat portion from which a projection protrudes in the form of a bead. This bead can be constructed, for example, as a continuation of the circular cross section of the remaining coil tube circumference.

BRIEF DESCRIPTION OF THE DRAWINGS

The invention is explained in more detail in the following text using exemplary embodiments and with reference to the drawing, in which.

DETAILED DESCRIPTION OF THE PREFERRED EMBODIMENTS

Figure 1:
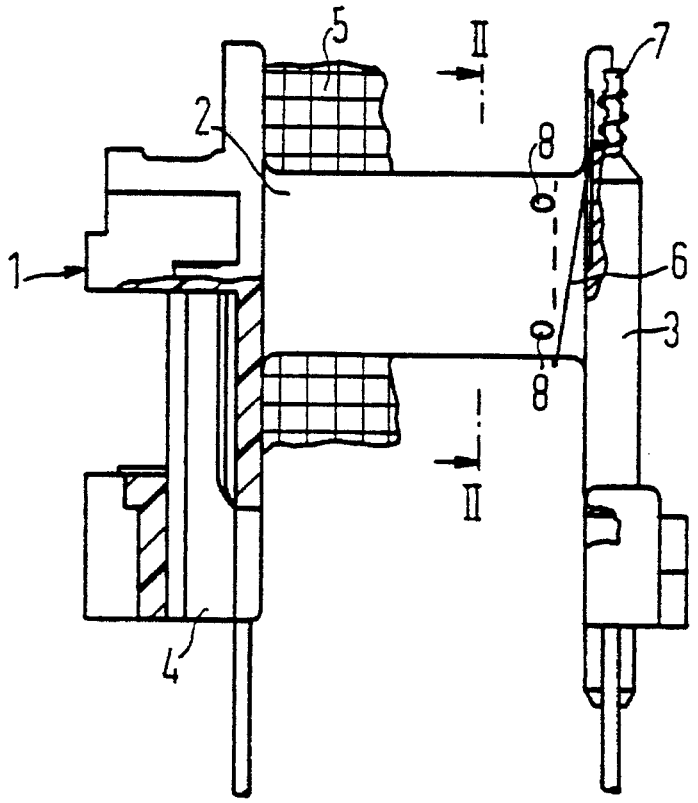
FIGS. 1 and 2 show a coil former with a winding indicated in a partially cut-away side view as well as in cross section.
Figure 2:
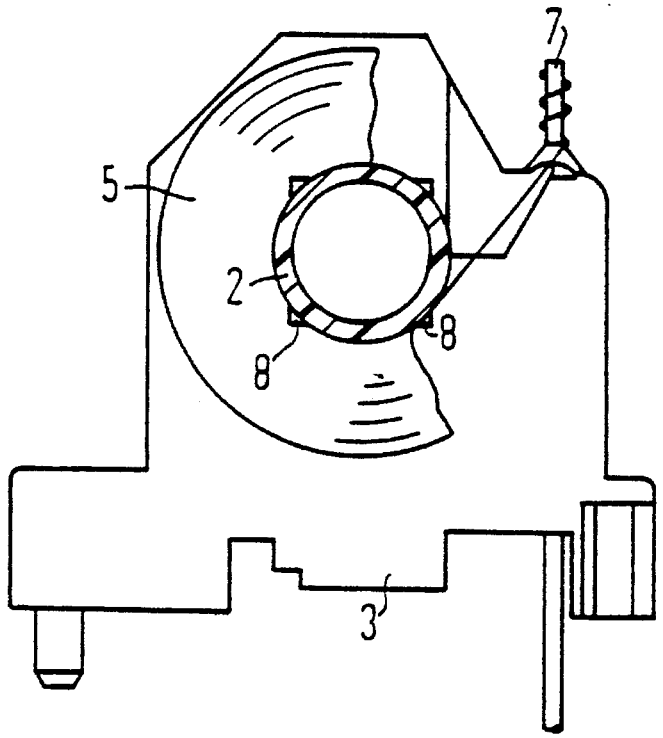

The coil which is shown in FIGS. 1 and 2 has a coil former 1 which has a coil tube 2 as well as two flanges 3 and 4. The coil tube 2 has a circular cross section and an internal hole for accommodating an iron core which is not illustrated. A winding 5, composed of copper wire which is sheathed thermoplastically, is wound on the external circumference of the coil tube 2. In this case, the winding start 6 is initially attached to a connecting pin 7 which is anchored in the coil flange 3.

As a result of temperature influences and ageing, a compact winding stack 5, which can be seated loosely on the coil tube 2 after a certain amount of time, is produced by baking the wire insulation. In order in this case to prevent twisting or axial movement, the coil tube 2 has wedge-shaped knobs 8 which are arranged on a common radial plane in the vicinity of the winding start 6. While the winding is being fitted, these knobs 8 bore themselves from the inside into the winding stack and thus prevent later movement. Since the knobs 8 are located in the vicinity of the coil flange 3, the shrinking winding stack is pulled in the direction of the endangered winding start 6, so that stress in the longitudinal direction is prevented.

Figure 3:
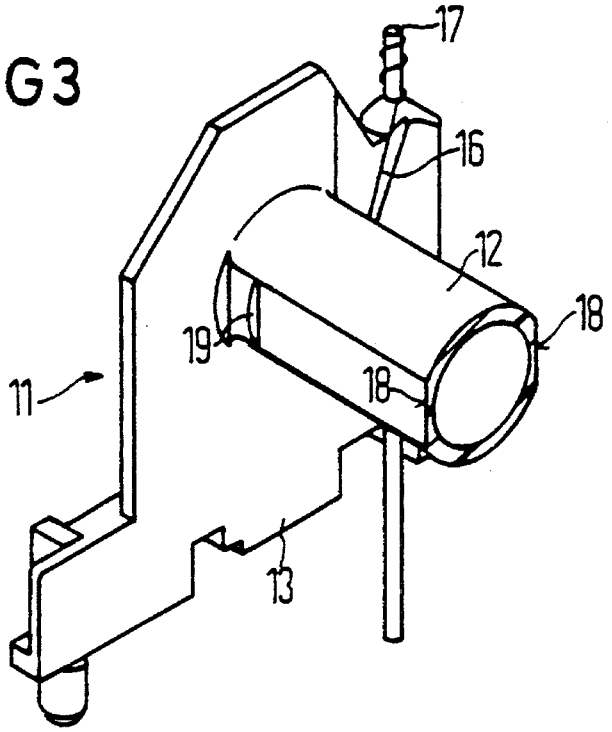
FIGS. 3 and 4 show a further embodiment of a coil former in a perspective sectional representation and in side view.
Figure 4:
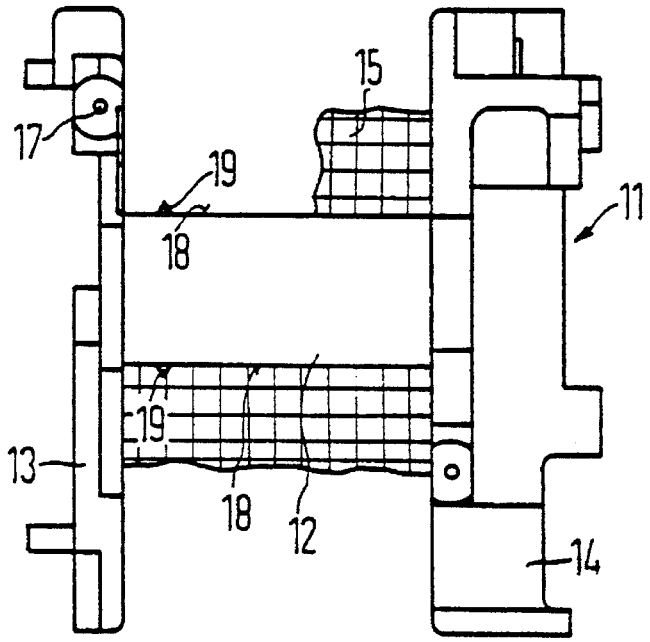

FIGS. 3 and 4 show a somewhat modified embodiment. In this case, a coil former 11 has a coil tube 12 with flanges 13 and 14. A winding 15 is fitted on the coil tube, a winding start 16 being attached to a connecting pin 17 in the coil flange 13.

The coil tube 12 in this case has a lateral flat 18, so that the winding stack 15, which is matched to the external circumference of the coil tube, can also not be twisted on the coil tube in the event of a certain amount of shrinkage. In order also to prevent axial displacement of the winding stack 15, the flat 18 is in each case interrupted by a bead 19 in the vicinity of the winding start 16, the bead in this case being constructed as a continuation of the circular envelope surface of the coil tube 12.

Although other modifications and changes may be suggested by those skilled in the art, it is the intention of the inventor to embody within the patent warranted hereon all changes and modifications as reasonably and properly come within the scope of his contribution to the art.

We claim:

1. A coil for an electromagnetic relay, comprising:

a winding stack subject to shrinkage;

a unitary, one-piece coil former of insulating material including:

a coil tube, whose basic shape is cylindrical, as a support for said winding stack, two flanges as axial boundaries of a winding space on said coil tube in which said winding stack is mounted, said winding stack being wound on said coil tube in said winding space and said winding stack having an end spaced a distance from one of said flanges;

at least one tab-shaped projection disposed on said coil tube and covered by and engaging into said end of said winding stack and comprising means for preventing movement of said end of said winding stack in an axial direction on an external circumference of said coil tube and for preserving said distance between said end of said winding stack and said one of said flanges upon shrinkage of said winding stack, said coil tube being free of projections in an axial direction from said at least one tab-shaped projection.

2. A coil as claimed in claim 1, wherein said at least one projection comprises a plurality of tab-shaped projections distributed over a circumference of said coil tube in a common radial plane.

3. A coil as claimed in claim 1, wherein an external circumference of said coil tube has at least one flat portion, and said at least one projection comprises a bead projecting from said at least one flat portion as a projection.

4. A coil as claimed in claim 3, wherein said bead is a continuation of a circular cross section of said external circumference.

5. A coil as claimed in claim 1, wherein said one of said two flanges is attached to which a winding start extending from said end of said winding stack.

* * * * *